US007550925B2

(12) United States Patent
Lesch et al.

(10) Patent No.: US 7,550,925 B2
(45) Date of Patent: Jun. 23, 2009

(54) GAS DISCHARGE LAMP WITH REDUCED ELECTROMAGNETIC INTERFERENCE RADIATION

(75) Inventors: Norbert Lesch, Vaals (NL); Willebrordus Gerardus Traa, Leende (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 121 days.

(21) Appl. No.: 10/549,237

(22) PCT Filed: Mar. 8, 2004

(86) PCT No.: PCT/IB2004/050209

§ 371 (c)(1),
(2), (4) Date: Sep. 12, 2005

(87) PCT Pub. No.: WO2004/084250

PCT Pub. Date: Sep. 30, 2004

(65) Prior Publication Data

US 2006/0186815 A1 Aug. 24, 2006

(30) Foreign Application Priority Data

Mar. 18, 2003 (EP) ..... 03100690

(51) Int. Cl.
*H01J 61/35* (2006.01)

(52) U.S. Cl. ..... 313/635; 313/580; 313/634; 313/573; 313/489

(58) Field of Classification Search ..... 313/317, 313/318.01–318.3, 568, 569, 594, 574, 622, 313/282, 283, 595, 607, 234, 489, 580, 573, 313/517, 643, 637, 635, 634, 631, 632; 315/300, 315/306, 291; 362/487, 459, 475, 509; 445/26, 445/72, 24

See application file for complete search history.

(56) References Cited

U.S. PATENT DOCUMENTS 3,649,864 A * 3/1972 Willemsen ..... 313/622

(Continued)

FOREIGN PATENT DOCUMENTS

DE 4101722 A1 10/1991

(Continued)

OTHER PUBLICATIONS

ISR, Written Opinion of the International Searching Authority PCT/IB2004/050209.

*Primary Examiner*—Joseph L Williams
*Assistant Examiner*—Fatima N Farokhrooz

(57) ABSTRACT

A gas discharge lamp (1) with a discharge vessel (2), a first electrode (3) projecting into the discharge vessel (2), and a second electrode (4) projecting into the discharge vessel (2) is described. The first electrode (3) is connected to an electrically conductive first conductor surface (5) surrounding the discharge vessel (2). The second electrode (4) is connected to an electrically conductive second conductor surface (6) surrounding the discharge vessel (2) and arranged such that it overlaps the first conductor surface (5) so as to form a capacitance (C).

20 Claims, 2 Drawing Sheets

Figure 1:
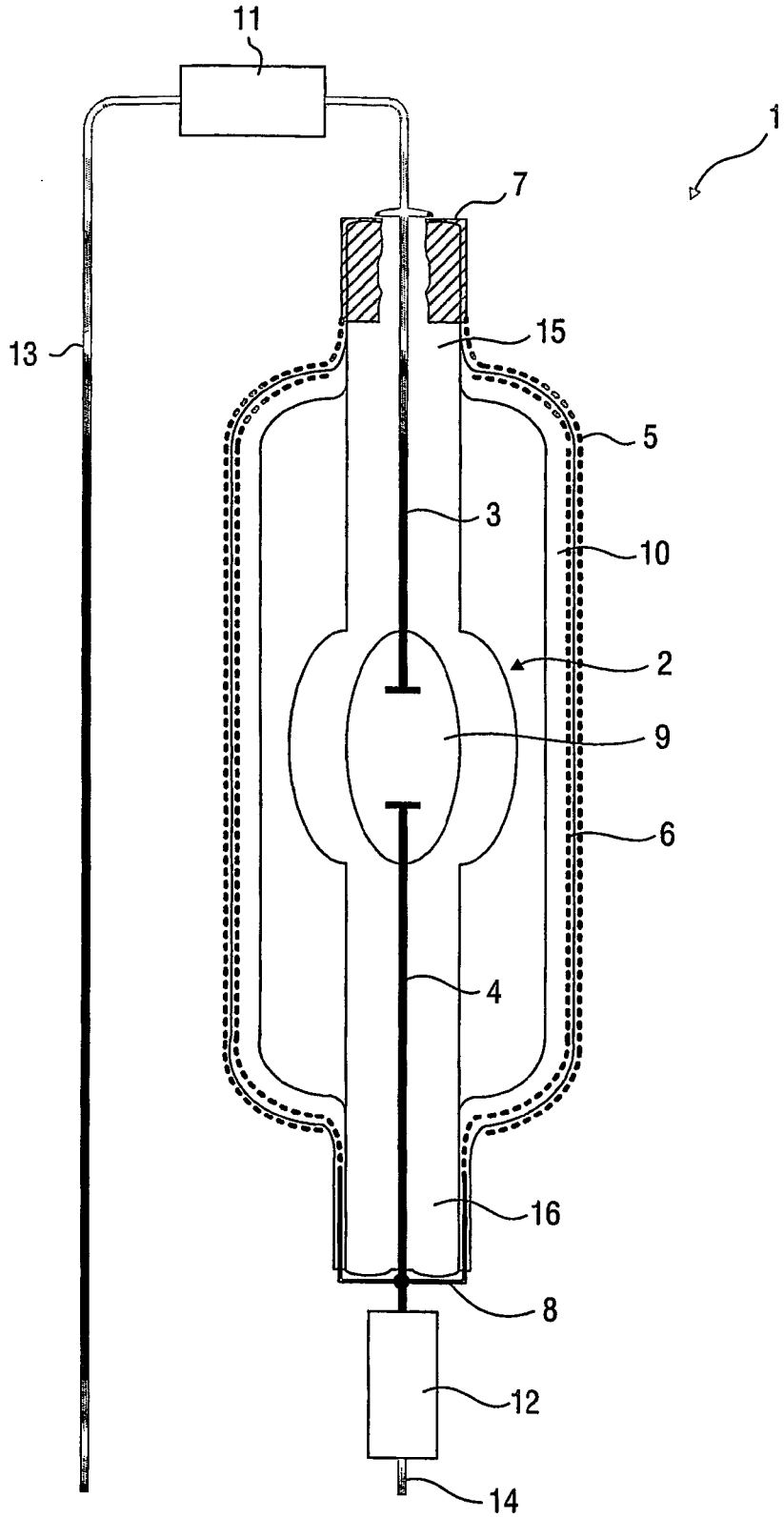

U.S. PATENT DOCUMENTS 3,758,819 A * 9/1973 Goldberg ..... 315/204
4,053,809 A * 10/1977 Fridrich et al. ..... 313/594
4,260,934 A * 4/1981 Kuus et al. ..... 315/326
5,359,255 A * 10/1994 Kawai et al. ..... 313/17
5,906,428 A 5/1999 Hori et al.
6,040,658 A * 3/2000 Bashlov et al. ..... 313/637
6,153,982 A 11/2000 Reiners
6,364,515 B1 * 4/2002 Daub et al. ..... 362/548
6,724,145 B1 * 4/2004 Muto et al. ..... 313/638

FOREIGN PATENT DOCUMENTS

DE 19538064 A1 4/1997
DE 19753610 A1 6/1999
GB 2035674 * 11/1978
JP 05159742 A 6/1993

* cited by examiner

GAS DISCHARGE LAMP WITH REDUCED ELECTROMAGNETIC INTERFERENCE RADIATION

The invention relates to a gas discharge lamp and to a headlight, in particular a vehicle headlight, or a luminaire with a corresponding gas discharge lamp.

Gas discharge lamps have been used ever more widely for a number of years in the vehicle headlight industry because of their excellent light emission efficiency and color characteristics as well as their long operational lives. Such gas discharge lamps have a discharge vessel which is filled with an inert gas and which is made from a translucent, heat-resistant material, for example from quartz glass. Electrodes project into this discharge vessel, and a voltage is applied to these electrodes for ignition and for operation of the lamp. Typical gas discharge lamps used nowadays in motor vehicles are, for example, so-termed HID (High Intensity Discharge) lamps such as, for example, high-pressure sodium lamps, and in particular MPXL (Micro Power Xenon Light) lamps, which operate with a filling of xenon gas. A problem in the use of such gas discharge lamps is, however, that the physical properties of the respective inert gas, for example the xenon gas, and the discharge phenomenon resulting therefrom cause the discharge lamp to emit not only the desired light, but also a high proportion of electromagnetic interference radiation in the high-frequency range. The range of up to 1 GHz is particularly problematic here. The electromagnetic undesirable radiation is primarily radiated by the electrodes and the supply lines to the discharge vessel, which components act as antennas driven by the discharge vessel when it is in the operational state. Since this interference radiation leads to electromagnetic interference with other electronic units of a vehicle such as, for example, an audio set, an ABS, an airbag control, etc., and could consequently lead to malfunctions in the relevant devices, there are legal EMC (electromagnetic compatibility) requirements as well as comparatively stringent EMC requirements set by the automobile industry itself, for example CISPR25. It is therefore necessary to reduce the undesirably radiated electromagnetic energy. The possibilities for modifying the interference source emitting the electromagnetic interference itself, i.e. the lamp itself, such that it radiates less electromagnetic energy in the relevant range, are very limited because of the fundamental physical properties of the lamp and the power requirements imposed on the lamp. This is why measures to improve the EMC are usually taken such that the electromagnetic interference emission is prevented from being radiated into the surroundings.

A usual method of reducing the electromagnetic interference radiation nowadays that the entire lamp is screened off as well as possible inside the headlight, for example in that the reflector or additional screening parts inside the lamp are grounded, as is described in U.S. Pat. No. 5,906,428. Such a screening of the lamp and its supply lines by means of metal or other conductive components of the headlight, however, is comparatively complicated and expensive. In addition, there is the risk that a conductive object surrounding the radiation source will itself act as an antenna and accordingly have the opposite effect in the case of an insufficient screening, for example caused by bad contacts of a ground connection.

It is accordingly an object of the present invention to provide a gas discharge lamp which emits a small quantity of electromagnetic interference radiation in all cases during operation.

This object is achieved by means of a gas discharge lamp which comprises a discharge vessel, a first electrode projecting into the discharge vessel and a second electrode projecting into the discharge vessel, as well as an electrically conductive first conductor surface that is connected to the first electrode and surrounds the discharge vessel at least partly, and an electrically conductive second conductor surface that is connected to the second electrode, surrounds the discharge vessel at least partly, and is arranged so as to overlap the first conductor surface at least partly, thus forming a capacitive element. The two conductor surfaces form a decoupling capacitor connected on the one hand to the one electrode and on the other hand to the other electrode directly at the gas discharge lamp, which capacitor acts as a short-circuit between the two electrodes for the high-frequency currents. The electromagnetic interference emission is reduced in an efficient manner directly at the gas discharge lamp in this manner.

Since the electromagnetic interference radiation is reduced directly at the lamp itself, according to the invention, the lamp may advantageously be used in any type of vehicle headlight or alternatively in headlights or luminaires for other lighting purposes, as may be desired. No special screenings or other components for suppressing the electromagnetic interference radiation need be present then adjacent the relevant headlights or luminaires. An incorporation of the gas discharge lamps according to the invention in headlights or luminaires which comprise additional EMC shields—such as, for example, a headlight of the kind mentioned in the opening paragraph—is equally well possible, however. In that case it may be possible to reduce the emission values even further through the special combination of the gas discharge lamp according to the invention and the additional screening devices of the headlight or the luminaire, which may be advantageous for applications in surroundings which are electromagnetically particularly sensitive.

It should preferably be heeded in the construction and arrangement of the conductor surfaces that as high as possible a capacitance is formed, such that the impedance for the high-frequency currents is as low as possible. To form a capacitance which is as high as possible, the two conductor surfaces should accordingly be mutually insulated, but be arranged as close together as possible and have as large as possible an overlap.

The first electrode and the second electrode project from two connection locations arranged at two mutually opposed ends of the discharge vessel into the discharge vessel in many gas discharge lamps used in motor vehicle headlights. In such gas discharge lamps, the first conductor surface is preferably connected to the first electrode at the connection location of the first electrode and extends in the direction of the connection location of the second electrode. Conversely, the second conductor surface is preferably connected to the second electrode at the connection location of this second electrode and extends in the direction of the connection location of the first electrode, such that it overlaps the first conductor surface at least in an end region remote from the connection location of the second electrode. This means that the two conductor surfaces extend outside the discharge vessel substantially parallel to the associated electrodes in the direction of the connection location of the other electrode so far that the two conductor surfaces have a sufficient degree of overlap.

In a particularly preferred embodiment, the discharge vessel is substantially fully screened by the first conductor surface and/or the second conductor surface, or at least by the total surface formed by the conductor surfaces. To achieve this, the conductor surfaces each extend preferably from the connection location of the respective electrode in the form of a screen—similar to the outer conductor of a coax cable—around the discharge vessel over a certain distance. It is particularly preferred that each conductor surface extends up to close to the opposed connection location of the respective other electrode. If the two conductor surfaces are arranged as screens in this manner, a very large covering surface area is the result, so that a correspondingly high capacitance is formed.

In addition, the conductor surface may be arranged in an alternative shape and may extend, for example, only over a certain region outside the discharge vessel, without a full screening of the discharge vessel being achieved. In particular, the conductor surfaces in a further preferred embodiment may also comprise exactly defined voids or holes in certain regions, where a particularly high luminous emission of the lamp is desired.

In a particularly preferred embodiment, the first conductor surface and/or the second conductor surface is arranged at an outer bulb surrounding the discharge vessel. Most modern gas discharge lamps have an outer bulb anyway, which fully surrounds the discharge vessel and serves inter alia for absorbing the ultraviolet radiation generated in the discharge. This outer bulb accordingly suggests itself for use as a carrier for the conductor surfaces.

Highly preferably, the conductor surfaces are then arranged in several layers on or in a wall of the outer bulb, mutually insulated but at a small distance from one another. In this case, at least one of the conductor surfaces is located in the wall or on the inside of the wall of the outer bulb. Alternatively, both conductor surfaces may be integrated into the wall of the outer bulb. The integration of a conductor surface in the wall of the outer bulb has the advantage that at least this conductor surface will be fully electrically insulated from its surroundings. It should be heeded here that a high voltage of a few kV is to be applied to one of the electrodes for igniting the gas discharge lamp, which voltage will then inevitably also be applied to the conductor surface connected to the relevant electrode.

There are various possibilities for realizing the conductor surfaces.

Thus, for example, the conductor surfaces may consist of a conductive, translucent material such as, for example, FTO (fluoride-doped tin oxide) in the form of a continuous layer arranged on or in the wall of the outer bulb. An alternative is a grid structure of a conductive material, for example a metal, which grid structure should be arranged such that in total still sufficient light is transmitted through the grid. Further, alternative metal structures are also possible.

It is also possible in principle that the first and the second conductor surface are of different constructions, for example the first conductor surface is a layer of a conductive, translucent material inside the wall of the outer bulb, and the second conductor surface is a metal grid structure or some similar structure that has been vapor-deposited on the outer bulb.

In a preferred embodiment, an inductive element such as, for example, a ferrite bead, a coil, or some such element is connected to the first electrode or to the second electrode, as close as possible to the relevant connection location of the electrode. It is particularly preferred that an inductive element is connected to each of the electrodes. The connection of the respective electrode to the electrical system for operating the gas discharge lamp is then achieved through the associated inductive element. The inductive elements together with the capacitance formed by the conductor surfaces form a highly effective low-pass filter which blocks or filters out high-frequency currents in a comparatively reliable manner. Only low-frequency currents in the range of the usual operating frequency of approximately 250 to 1000 Hz, preferably 400 Hz, which are necessary for a continuous operation of the gas discharge lamp, are admitted by this low-pass filter.

As was noted above, the gas discharge lamp according to the invention may in principle be used in any headlights and luminaires, as desired. A particularly preferred headlight, however, comprises an inductive element on the outer side of a first connection element for connecting the first electrode of the gas discharge lamp and/or of a second connection element for connecting the second electrode of the gas discharge lamp, through which inductive element finally the connection of the electrodes to the driver device necessary for operating the gas discharge lamp is obtained. These inductive elements may again be ferrite beads, coils, or the like. Such a headlight with inductive elements already arranged at the lamp connectors has advantages especially if gas discharge lamps according to the invention are used which themselves comprise no inductive elements at their electrode connections, as described above, for example for financial reasons.

Figure 2:
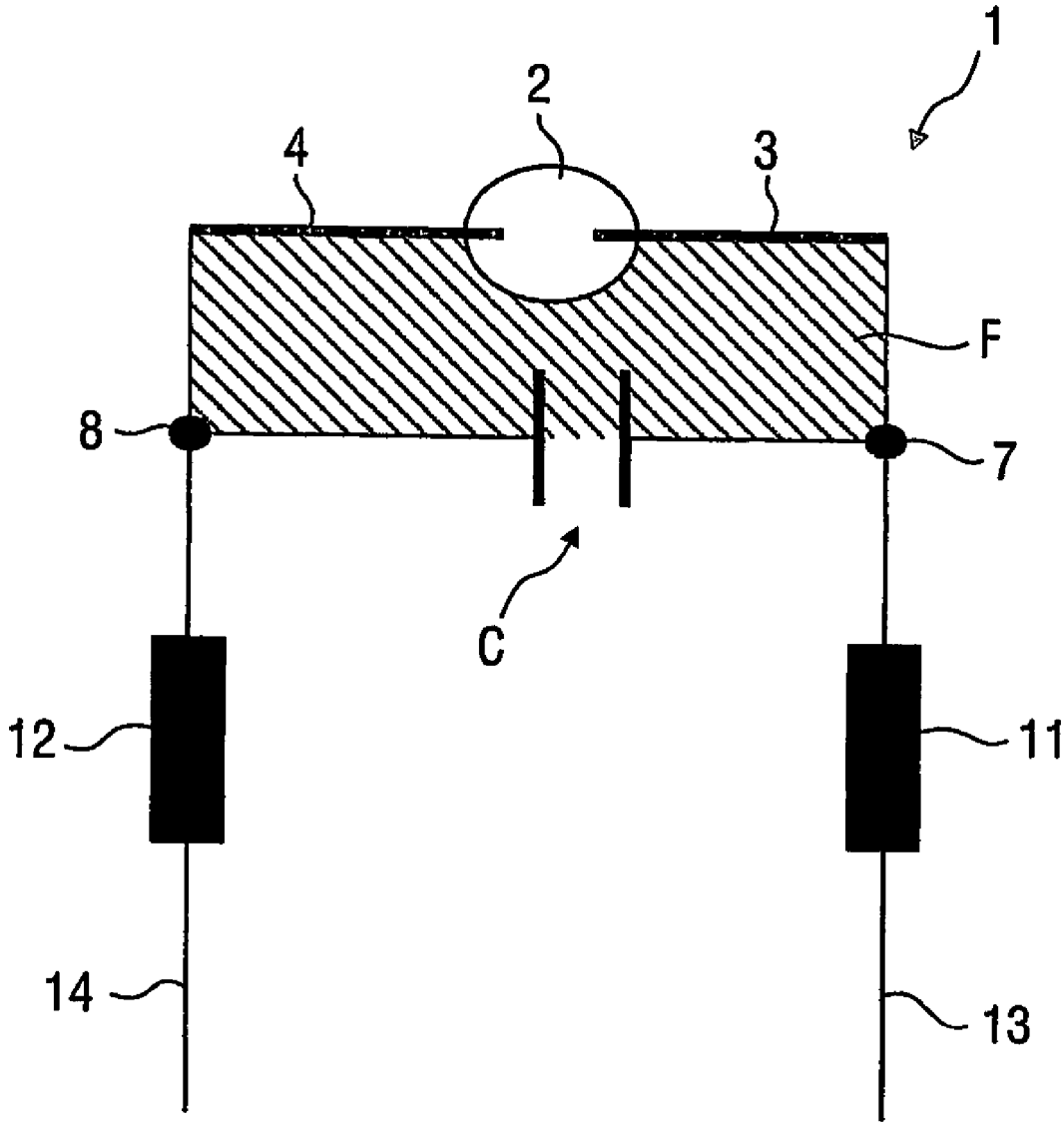

The invention will be explained in more detail below with reference to the accompanying Figures and an embodiment. Identical components have been given the same reference numerals in the Figures, in which:

FIG. 1 is a diagrammatic longitudinal sectional view of an embodiment of a gas discharge lamp according to the invention, and FIG. 2 is an equivalent circuit diagram of the gas discharge lamp of FIG. 1.

FIG. 1 shows a typical MPXL lamp 1. Such an MPXL lamp 1 comprises an inner discharge vessel 2 (also denoted inner bulb or burner), usually made of quartz glass, with an inner space 9 of only a few cubic millimeters. A first electrode 3 and a second electrode 4 extend into the discharge vessel 2, i.e. the inner space 9 thereof, from two mutually opposed ends in a usual manner. The electrodes 3, 4 are passed to the exterior through cylindrical end portions 15, 16 of the gas discharge vessel 2 with hermetical sealing, so that the inner space 9 is sealed off from the surroundings. The inert gas, xenon in this case, is present in the inner space 9 of the discharge vessel 2 at a comparatively high pressure. A high voltage is applied between the electrodes 3, 4 for igniting the gas discharge lamp 1. During subsequent operation, i.e. after ignition of the lamp 1, an AC voltage with a frequency of approximately 400 Hz and with upper and lower peak voltages of approximately 12 V and approximately −73 V, respectively, on either side is applied to the electrodes 3, 4.

The discharge vessel 2 is surrounded by an outer bulb 10 which is filled with a gas, in particular air, and which is sealed against the surrounding atmosphere so as to absorb inter alia ultraviolet radiation arising in the discharge, which outer bulb also usually consists of quartz glass and is fixedly connected to the discharge vessel 2 at the end portions 15, 16 of this discharge vessel 2.

The electrode 3, 4 is connected to a supply line 13, 14 via two connection locations 7, 8 arranged at the end regions 15, 16 of the discharge vessel 2 when the lamp is located in a headlight or a luminaire, said supply lines in their turn being connected to a suitable driver device (not shown) which supplies the high voltage for igniting the lamp 1 and the AC voltage for its operation.

According to the invention, two separate, mutually insulated, conductive conductor surfaces 5, 6 in the form of translucent films or layers or metal grid structures are present on or in the outer bulb 10. The first of these conductor surfaces 5 is present on the outer wall of the outer bulb 10 in this case. The second conductor surface 6 is arranged as a layer within the wall of the outer bulb 10 such that there is only a very small distance between the second conductor surface 6 and the first conductor surface 5. The conductor surfaces 5, 6 each enclose the discharge vessel 2 substantially entirely in the form of a screen. They are accordingly also denoted screens 5, 6 hereinafter.

The first screen 5 is conductively connected to the first electrode 3 at the connection location 7. The second screen 6, which is formed as a layer within the wall of the outer bulb 10, is connected with electrical conduction to the second electrode 4 at the other connection location 8. The end of each screen 5, 6 situated opposite the relevant connection location 7, 8 where the relevant screen 5, 6 is connected to the associated electrode 3, 4 is without electrical contact, i.e. electrically floating.

The large overlapping surface area and the small mutual distance imply that the first screen 5 and the second screen 6 form a capacitor C of sufficiently high capacitance, which short-circuits the two electrodes 3, 4 for high-frequency currents.

This is particularly apparent from the equivalent circuit diagram of FIG. 2. The high-frequency short-circuit between the two electrodes 3, 4 makes the effective cross-sectional surface area F of the antenna formed by the electrodes 3, 4 very small, said antenna being responsible in principle for transmitting the high-frequency electromagnetic interference radiation. This effective antenna cross-sectional surface area F is shown hatched in the equivalent circuit diagram of FIG. 2. Since the power of an antenna is dependent in principle on the effective cross-sectional surface area, and this area F is very small here, the result is that the electromagnetic interference radiation will be small in all cases in the gas discharge lamp 1 according to the invention. The cross-sectional surface area F defined by the coaxial arrangement of the system may even be regarded as approximating 0 in practice with this invention.

Ferrite beads 11, 12 are connected as inductances directly to the connection locations 7, 8 of the electrodes 3, 4 so as to improve the effect of the decoupling capacitor C formed by the double overlapping screen even further. These ferrite beads 11, 12 together with the decoupling capacitor C form a highly effective low-pass filter which filters out the high-frequency interference radiation substantially entirely and only allows low-frequency currents necessary for supplying the gas discharge lamp 1 during operation to pass.

Since the second screen 6 is present inside the wall of the outer bulb, it is possible to apply the high voltage necessary for igniting the gas discharge lamp 1 to the second electrode 4 connected to this second screen 6 without the risk that high-voltage live parts could be touched by human hands.

Suitable materials for forming the electrically conductive layers 5, 6 are available at present. It is possible in principle both to introduce such layers into the wall and to provide them on the wall of the outer bulb 10. The invention accordingly offers a comparatively simple and thus also inexpensive possibility for effectively reducing electromagnetic interference radiation during operation of a gas discharge lamp 1, such that special constructional measures for the associated headlights or luminaires, in which the gas discharge lamp according to the invention is operated, are not strictly necessary.

It is noted for completeness' sake once more that the gas discharge lamp 1 shown in FIGS. 1 and 2 is merely an example. Thus the invention is applicable in principle to other types of gas discharge lamps. In addition, for example, the ferrite beads 11, 12 or similar inductive elements arranged directly at the lamp 1 in FIG. 1 may alternatively be arranged in a headlight or a luminaire, for example in the lampholder, instead of directly at the lamp 1, so as to reduce the cost of the gas discharge lamp itself further, the latter after all being merely a dispensable article.

The invention claimed is:

1. A gas discharge lamp with an inner discharge vessel including an inner space, said inner discharge vessel surrounded by an outer bulb, wherein the outer bulb includes an electrically conductive first conductor surface arranged on an outer wall of the outer bulb of said discharge lamp and a second conductor surface embedded in the wall of the outer bulb, wherein said first conductor surface and said second conductor surface are mutually insulated and substantially enclose said discharge vessel in the form of a screen;

a first electrode projecting into the discharge vessel, a second electrode projecting into the discharge vessel, said electrically conductive first conductor surface being conductively connected to the first electrode at an end region of the first electrode outside of the discharge vessel and at least partly surrounding the discharge vessel, and said electrically conductive second conductor surface being conductively connected to the second electrode at an end region of the second electrode outside of the discharge vessel and surrounding the discharge vessel, the first and second conductor surfaces being positioned outside of the discharge vessel thus forming a decoupling capacitor which short-circuits the first electrode and second electrode for high-frequency currents.

2. A gas discharge lamp as claimed in claim 1, wherein the first electrode and the second electrode extend into the discharge vessel from connection locations arranged at mutually opposed ends of the discharge vessel, and in that the first conductor surface is connected to the first electrode in the connection location of the first electrode and extends in the direction of the connection location of the second electrode, and in that the second conductor surface is connected to the second electrode at the connection location of the second electrode and extends in the direction of the connection location of the first electrode such that it overlaps the first conductor surface at least in an end region remote from the connection location of the second electrode.

3. A gas discharge lamp as claimed in claim 1, wherein the first conductor surface and/or the second conductor surface and/or the total surface formed by the two conductor surfaces screen off the discharge vessel substantially entirely.

4. A gas discharge lamp as claimed in claim 1, wherein the first conductor surface and/or the second conductor surface is arranged at an outer bulb that envelops the discharge vessel.

5. A gas discharge lamp as claimed in claim 1, wherein an inductive element connected to the first electrode and/or an inductive element connected to the second electrode, via which the respective electrode is connected to a supply line for the operation of the gas discharge lamp.

6. A gas discharge lamp as claimed in claim 4, wherein the conductor surfaces are arranged in different layers on or in a wall of the outer bulb.

7. A gas discharge lamp as claimed in claim 4, wherein the first and/or the second conductor surface comprises a layer of a conductive, translucent material.

8. A gas discharge lamp as claimed in claim 4, wherein the first and/or the second conductor surface comprises a grid structure of a conductive material.

9. A headlight or luminaire comprising: a gas discharge lamp with an inner discharge vessel including an inner space, said inner discharge vessel surrounded by an outer bulb, wherein the outer bulb includes an electrically conductive first conductor surface arranged on an outer wall of the outer bulb of said discharge lamp and a second conductor surface embedded in the wall of the outer bulb, wherein said first conductor surface and said second conductor surface are mutually insulated and substantially enclose said discharge vessel in the form of a screen;

a first electrode projecting into the discharge vessel, a second electrode projecting into the discharge vessel, said electrically conductive first conductor surface conductively connected to the first electrode at an end region of the first electrode outside of the discharge vessel and at least partly surrounding the discharge vessel, and said electrically conductive second conductor surface being conductively connected to the second electrode at an end region of the second electrode outside of the discharge vessel and surrounding the discharge vessel, the first and second conductor surfaces being positioned outside of the discharge vessel thus forming a decoupling capacitor which short-circuits the first electrode and second electrode for high-frequency currents.

10. A headlight or luminaire of claim 9, further comprising: a first connection element for connecting the first electrode of the gas discharge lamp and a second connection element for connecting the second electrode of the gas discharge lamp, and by an inductive element arranged to the outer side of the first connection element and/or the second connection element.

11. A gas discharge lamp with an inner discharge vessel including an inner space, said inner discharge vessel surrounded by an outer bulb, wherein the outer bulb includes an electrically conductive first conductor surface embedded in a wall of the outer bulb of said discharge lamp and a second conductor surface embedded in the wall of the outer bulb, wherein said first and second surfaces are separated by a small distance and electrically insulated, wherein said first conductor surface and said second conductor surface are mutually insulated and substantially enclose said discharge vessel in the form of a screen;

a first electrode projecting into the discharge vessel, a second electrode projecting into the discharge vessel, said electrically conductive first conductor surface being conductively connected to the first electrode at an end region of the first electrode outside of the discharge vessel and at least partly surrounding the discharge vessel, and said electrically conductive second conductor surface being conductively connected to the second electrode at an end region of the second electrode outside of the discharge vessel and surrounding the discharge vessel, the first and second conductor surfaces being positioned outside of the discharge vessel thus forming a decoupling capacitor which short-circuits the first electrode and second electrode for high-frequency currents.

12. A gas discharge lamp as claimed in claim 11, wherein the conductor surfaces are arranged in different layers on or in a wall of the outer bulb.

13. A gas discharge lamp as claimed in claim 11, wherein the first and/or the second conductor surface comprises a layer of a conductive, translucent material.

14. A gas discharge lamp as claimed in claim 11, wherein the first and/or the second conductor surface comprises a grid structure of a conductive material.

15. A gas discharge lamp as claimed in claim 11, wherein an inductive element connected to the first electrode and/or an inductive element connected to the second electrode, via which the respective electrode is connected to a supply line for the operation of the gas discharge lamp.

16. A gas discharge lamp with an inner discharge vessel including an inner space, said inner discharge vessel surrounded by an outer bulb, wherein the outer bulb includes an electrically conductive first conductor surface and a second conductor surface, wherein said first and second surfaces are separated by a small distance and electrically insulated, wherein said first conductor surface and said second conductor surface are mutually insulated and substantially enclose said discharge vessel in the form of a screen;

a first electrode projecting into the discharge vessel, a second electrode projecting into the discharge vessel, said electrically conductive first conductor surface being conductively connected to the first electrode at an end region of the first electrode outside of the discharge vessel and at least partly surrounding the discharge vessel, and said electrically conductive second conductor surface being conductively connected to the second electrode at an end region of the second electrode outside of the discharge vessel and surrounding the discharge vessel, the first and second conductor surfaces being positioned outside of the discharge vessel thus forming a decoupling capacitor which short-circuits the first electrode and second electrode for high-frequency currents.

17. A gas discharge lamp as claimed in claim 16, wherein the conductor surfaces are arranged in different layers on or in a wall of the outer bulb.

18. A gas discharge lamp as claimed in claim 16, wherein the first and/or the second conductor surface comprises a layer of a conductive, translucent material.

19. A gas discharge lamp as claimed in claim 16, wherein the first and/or the second conductor surface comprises a grid structure of a conductive material.

20. A gas discharge lamp as claimed in claim 16, wherein an inductive element connected to the first electrode and/or an inductive element connected to the second electrode, via which the respective electrode is connected to a supply line for the operation of the gas discharge lamp.

* * * * *